US005292146A

United States Patent [19]

Palau

[11] Patent Number: 5,292,146

[45] Date of Patent: Mar. 8, 1994

[54] REINFORCED SPATULA FOR SKIS

[75] Inventor: Marie-Claude Palau, St-Jorioz, France

[73] Assignee: Salomon S.A., Annecy Cedex, France

[21] Appl. No.: 655,039

[22] Filed: Feb. 14, 1991

[30] Foreign Application Priority Data

Feb. 21, 1990 [FR] France ..... 90 02376

[51] Int. Cl.[5] ..... A63C 5/06

[52] U.S. Cl. ..... 280/601; 280/608; 280/809

[58] Field of Search ..... 280/601, 602, 603, 608, 280/609, 610, 809, 816, 817

[56] References Cited

U.S. PATENT DOCUMENTS 3,424,469 1/1969 Hooker ..... 280/608
4,180,275 12/1979 Montoya ..... 280/601

FOREIGN PATENT DOCUMENTS 0229608 7/1987 European Pat. Off. .
2638928 3/1978 Fed. Rep. of Germany .
222569 7/1942 Switzerland .
504214 4/1971 Switzerland .

*Primary Examiner*—Richard M. Camby
*Attorney, Agent, or Firm*—Sandler Greenblum & Bernstein

[57] ABSTRACT

A ski comprising a central zone adapted to support the weight of a skier, a heel zone, and tip zone defining a spatula defined in thickness by an upper surface corresponding to the top of the ski and a lower surface corresponding to the sole of the ski wherein at least one of the lateral sides of the spatula is bordered by a reinforcement which projects with respect to at least one of the surfaces defining the thickness of the spatula.

19 Claims, 3 Drawing Sheets

REINFORCED SPATULA FOR SKIS

BACKGROUND OF THE INVENTION

1. Field of the Invention

The present invention relates to a ski and more particularly to an improvement to the front end of the ski.

2. Description of Background and Relevant Information

A ski is composed of three portions: a central portion, rear portion which is called a heel, and a front portion called a spatula. This spatula serves to allow the skier to pass over irregularities of the terrain such as snow drifts and to move such that the ski does not penetrate into the snow during skiing. For this purpose, the spatula is presented in the shape of a more or less rounded and raised point with respect to the snow. On the other hand, so as to simplify the manufacture of skis, it is known to manufacture them without a spatula, and to apply a supplemental element to them, called a "tip", at the end of manufacturing by gluing or ratcheting.

By virtue of its position, the spatula is the portion which is most exposed to shocks, in particular, during competition racing. In effect, during a slalom and especially for the special slalom, the skier seeks to pass as close as possible to the gates defining the path of the course, which leads the spatulas to hit often, and hard, against the gates.

SUMMARY OF THE INVENTION

An object of the present invention is to provide a reinforcement for the spatula of a ski, which may or may not include a separate tip, and to prevent its consequential degradation due to shocks. For this purpose, the lateral sides of the spatulas are rimmed with a reinforcement, thus forming a type of front shock absorber of the ski.

To fully play the role of shock absorber, the reinforcement of the spatula must have a configuration such that its capacity of shock absorption is optimal. For this, the manufacturer would be able in particular to vary the different dimensions of this reinforcement, such as thickness, height, cross-section. The end of the spatula has a tendency to have a thickness which is thinner and thinner, in a direction toward the spatula front end. The reinforcement thus projects, by a constant amount or by a variable amount, with respect to the lower surface or upper surface of the ski, as will be described below with reference to the annexed drawings.

There exist, furthermore, skis whose front ends are provided with applied tips which are of a dissymmetrical shape. Such tips are dissymetrical in the sense that the forwardmost point is offset from the from a longitudinal median plane of the ski in a direction toward the interior, i.e., toward the other ski of a pair of skis. An advantage of such a construction is that, particularly during the special slalom, a skier can more easily avoid having a ski pass on the wrong side of a gate.

In this case, the invention is likewise applicable but only the exterior side of the tip (left side for the left ski, right side for the right ski) will be protected by a reinforcement, as has previously been described.

This invention is applicable to all types of skis, to those adapted for example for alpine skiing, cross-country skiing, mountaineering skiing, ski jumping, monoski, without this list being in any way limiting.

BRIEF DESCRIPTION OF THE DRAWINGS

Other characteristics and advantages of the invention will become clear from the description which follows with reference to the annexed drawings which are given by way of non-limiting example only, in which.

DESCRIPTION OF PREFERRED EMBODIMENTS

Figure 1:
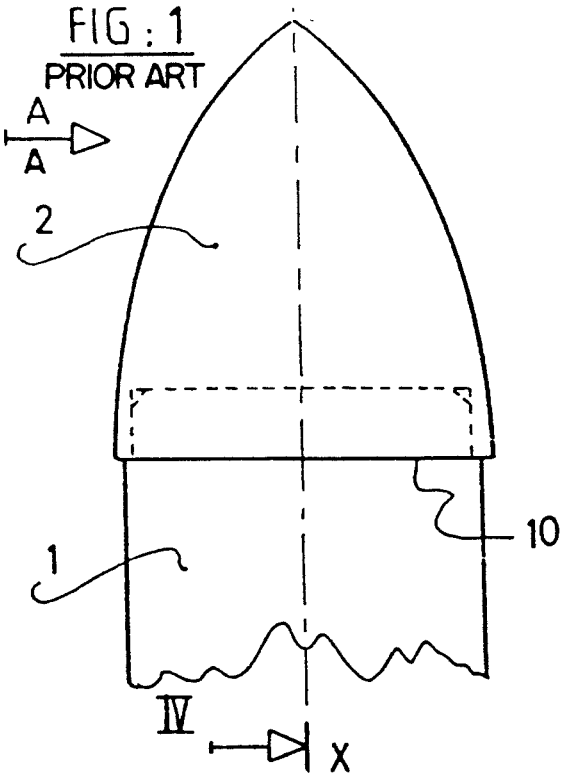
FIG: 1 PRIOR ART
FIG. 1 illustrates a top view of a ski.
Figure 2:
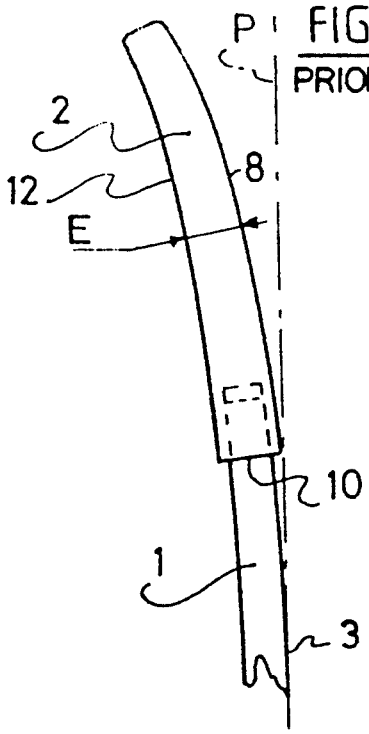
FIG: 2 PRIOR ART
FIG. 2 illustrates a side view taken in the direction of arrow A or FIG. 1.

FIGS. 1 and 2 illustrate the front end of ski 1 provided with a tip 2 applied to the ski by any means such as gluing or ratcheting. In this case, the tip comprises a side or rear end 10 for introduction onto the ski, two lateral sides in the form of a curve defining the general contour of a sort of conical point in the form of a curvilinear triangle, an upper surface 12 corresponding to the top of the ski and a lower surface 8 corresponding to the sole of the ski 1. This tip 2 is progressively raised towards the front with respect to plane P passing through the lower surface 3 of the ski. On the other hand, the more that tip 2 is raised, the more the thickness E of this tip is reduced.

Figure 3:
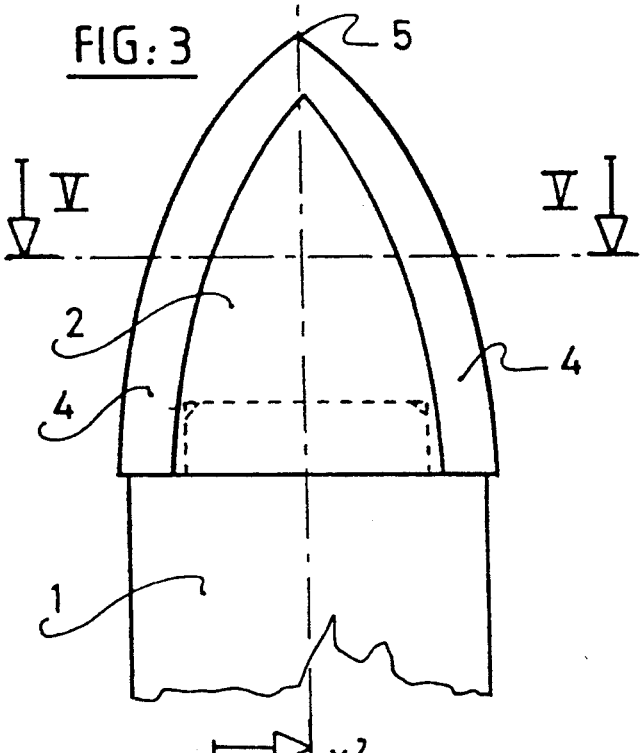
FIG. 3 illustrates a bottom view of a ski according to the invention.
Figure 4:
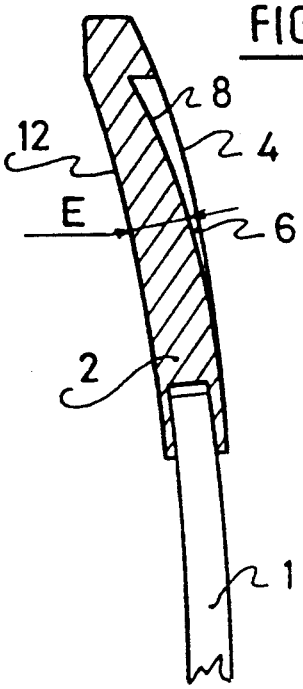
FIG. 4 is a cross-section, taken in the direction of the arrows at line IV—IV of FIG. 3.
Figure 5:
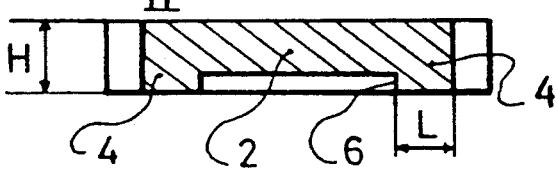
FIG. 5 illustrates a cross-section of a tip taken in the direction of the arrows at line V—V of FIG. 3.

According to the invention shown in FIGS. 3–5, the tip 2 is rimmed on each of its sides by a reinforcement 4. These reinforcements 4 are joined at the front end of the tip 2 at a point 5 positioned on the longitudinal axis of symmetry X X' of the ski 1.

Each reinforcement 4 has a thickness L and a height H which is substantially constant. By virtue of the fact that the central portion of the tip 2 comprises a thickness E which thins toward the front as shown in FIG. 4, and that each of reinforcements 4 projects with respect to the lower surface 8 of the central portion of tip 2, the this projection 6 projects from the lower surface of the ski with an increasing magnitude all in the direction toward the front of the ski. One does not go beyond the scope of the invention if each of the reinforcements projects with respect to the upper surface 12 of the ski.

Figure 6:
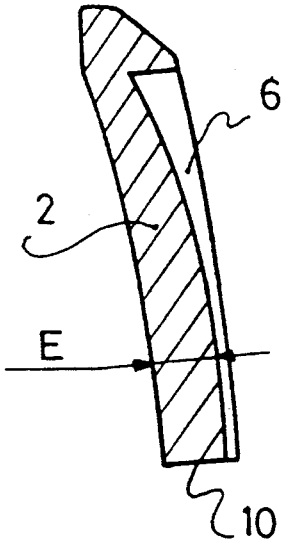
FIGS. 6, 7 and 8 illustrate in cross-section, taken in the direction of the arrows at line IV—IV of FIG. 3 other configurations of the invention illustrated in FIG. 4.
Figure 7:
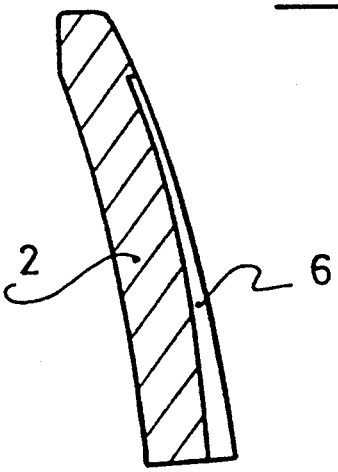
Figure 8:
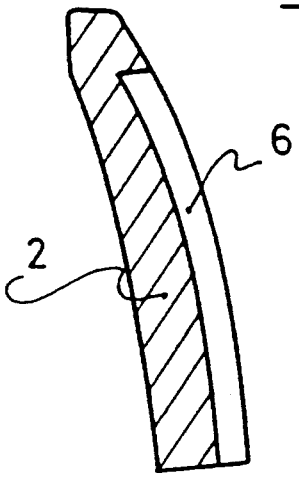

FIGS. 6, 7 and 8 illustrate three other configurations of reinforcement 4 according to the invention.

In FIG. 6, the projection 6 comprises a thickness which is variable when one approaches the front of the ski. While in FIG. 4, the thickness of reinforcement 4 at the level of the introduction base 10 of the tip 2 is approximately equal to the thickness E of the central portion of tip. FIG. 6 illustrates a projection 6 having at the level of introduction base 10 a thickness greater than that of the central portion of the tip 2, the thickness of the projection 6 subsequently varying as one approaches the front end.

In FIG. 7, projection 6 decreases in thickness as when one approaches the front of the ski.

In FIG. 8, projection 6 has a constant thickness when one approaches the front of the ski.

Figure 9:
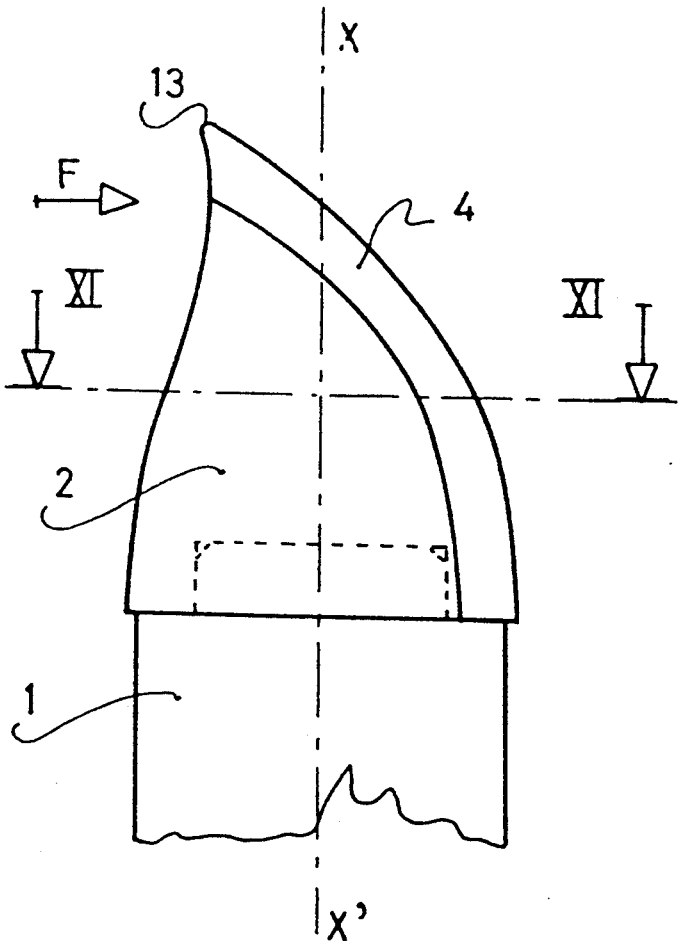
FIG. 9 illustrates an alternative embodiment of the invention as seen from the bottom.
Figure 10:
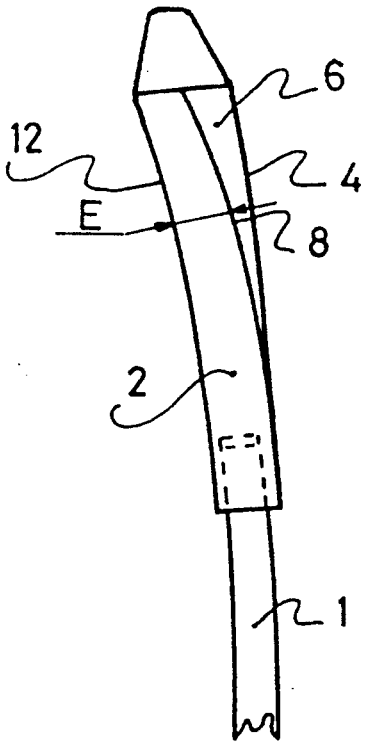
FIG. 10 is a view taken in the direction of arrow F of FIG. 9.

In another embodiment, shown in FIGS. 9 and 10, the invention is applied to a tip which is dissymmetrical with respect to the longitudinal axis of symmetry X—X' of the ski 1.

In this case, the reinforcement 4 extends on the lateral side of the spatula corresponding to the exterior of the ski until a point 13 which is offset from the longitudinal axis of symmetry X—X' of ski 1.

FIG. 9 illustrates a left ski seen from the bottom. But the construction is the same for a single lateral side of the tip provided with a single reinforcement as that previously described for tips having two reinforcement sides and one can in this case find the different variations shown in FIGS. 6, 7 and 8.

Figure 11:
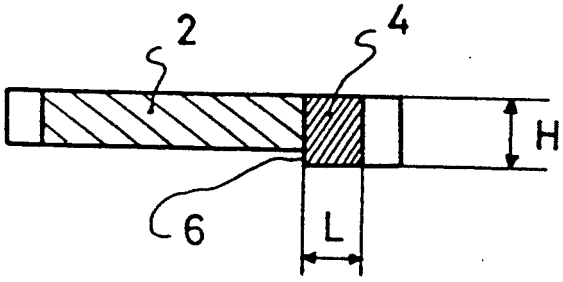
FIG. 11 illustrates a cross-section of the tip taken in the direction of the arrows at line XI—XI of FIG. 9.

FIG. 5 illustrates that the reinforcement 4 and the central portion of tip 2 are constituted by a single piece, preferably made of injected plastic material. On the other hand, FIG. 11 shows a reinforcement 4 constituted by a material which is different from that constituting the central portion of tip 2 or of the spatula if this is of a single piece with the ski. In this case, the linkage between the reinforcement 4 and the central portion of the tip 2 is made by any assembly means such as over molding, gluing or ratcheting. The invention described above is likewise applicable to a ski whose front end does not comprise a tip which has been added on. In this case, the tip and the one or more reinforcements are integrated directly into the structure of ski 1.

This application claims priority of French Application 90 02376 filed Feb. 21, 1990, the disclosure of which is hereby entirely incorporated by reference thereto.

Finally, although the invention has been described with reference to particular means, materials and embodiments, it is to be understood that the invention is not limited to the particulars disclosed and extends to all equivalents within the scope of the claims including combinations of the various embodiments.

What is claimed is:

1. A ski comprising:

a central portion, a rear portion, and a front portion, said front portion comprising a spatula;

said spatula comprising a tip affixed to said front portion of the ski;

said tip having a thickness defined by an upper surface and a lower surface;

said tip having at least a pair of lateral side portions, a rear end and a front end;

at least one reinforcement extending along and laterally bordering at least one of said pair of lateral side portions;

said reinforcement projecting with respect to at least one of said upper surface of said tip and said lower surface of said tip;

said reinforcement having a thickness defined by an upper reinforcement surface and a lower reinforcement surface, said reinforcement thickness increasing in magnitude from said rear end toward said front end of said tip.

2. The ski of claim 1, said reinforcement projecting with respect to said lower surface of said tip.

3. The ski of claim 1, said reinforcement projecting with respect to said upper surface of said tip.

4. The ski of claim 1, said reinforcement projecting with respect to both said upper surface of said tip and said lower surface of said tip.

5. The ski of claim 1, said at least one reinforcement comprising a reinforcement extending along each of said pair of lateral side portions of said tip.

6. The ski of claim 5, said ski having a longitudinal median plane, and said reinforcements extending along said pair of lateral side portions of said tip being joined at said front end of said tip.

7. The ski of claim 1, said ski having a longitudinal median plane, and said reinforcement extending along one of said lateral side portions from one side of said longitudinal median plane to said front end of said tip, said front end of said tip being positioned on the other side of said longitudinal median plane, said tip being dissymetrical in shape.

8. The ski of claim 7, said ski having an exterior side and an interior side, said one of said lateral side portions along which said reinforcement extends corresponding to said exterior of said ski.

9. The ski of claim 1, each of said at least one reinforcement being unitary with the remainder of said tip.

10. The ski of claim 1, each of said at least one reinforcement being formed unitarily with the remainder of said tip from injectable plastic material.

11. The ski of claim 1, each of said at least one reinforcement being non-unitary with the remainder of said tip.

12. The ski of claim 11, each of said at least one reinforcement and the remainder of said tip being formed from a plastic material.

13. The ski of claim 1, said at least one reinforcement comprises a single reinforcement secured to one of said lateral side portions of said tip by any of a plurality of assembly means.

14. The ski of claim 13, said single reinforcement and said one of said lateral side portions of said tip being made of different materials.

15. The ski of claim 1, said reinforcement having a thickness defined by an upper reinforcement surface and a lower reinforcement surface, the remainder of said tip having a thickness defined by an upper tip surface and a lower tip surface, said reinforcement thickness being greater than said tip thickness at said rear end of said tip.

16. The ski of claim 1, said ski having a lower surface, and said lower surface of said ski tip comprising an extension of said lower surface of said ski.

17. A ski comprising:

a central portion, a rear portion, and a front portion, said front portion comprising a spatula;

said spatula comprising a tip affixed to said front portion of the ski;

said tip having a thickness defined by an upper surface and a lower surface;

said tip having at least a pair of lateral side portions, a rear end and a front end;

at least one reinforcement extending along and laterally bordering at least one of said pair of lateral side portions;

said reinforcement projecting with respect to at least one of said upper surface of said tip and said lower surface of said tip;

said reinforcement having a thickness defined by an upper reinforcement surface and a lower reinforcement surface, the remainder of said tip having a thickness defined by an upper tip surface and a lower tip surface, said reinforcement thickness being generally equal to said tip thickness at said rear end of said tip, said reinforcement thickness being greater than said tip thickness at portions of said tip displaced from said rear end of said tip.

18. The ski of claim 17, said reinforcement having a thickness defined by an upper reinforcement surface and a lower reinforcement surface, said reinforcement thickness being generally constant along the length of said tip form said rear end of said tip to said front end of said tip.

19. A ski comprising:

a central portion, a rear portion, and a front portion, said front portion comprising a spatula;

said spatula comprising a tip affixed to said front portion of the ski;

said tip having a thickness defined by an upper surface and a lower surface;

said tip having at least a pair of lateral side portions, a rear end and a front end;

at least one reinforcement extending along and laterally bordering at least one of said pair of lateral side portions;

said reinforcement projecting with respect to at least one of said upper surface of said tip and said lower surface of said tip;

said reinforcement having a thickness defined by an upper reinforcement surface and a lower reinforcement surface, said reinforcement thickness decreasing in magnitude in a direction toward said front end of said tip.

* * * * *